US011167201B2

(12) United States Patent
Bostic

(10) Patent No.: US 11,167,201 B2
(45) Date of Patent: Nov. 9, 2021

(54) KIT FOR A GAME SYSTEM AND METHOD OF USE

(71) Applicant: Jessieca Bostic, Mount Olive, AL (US)

(72) Inventor: Jessieca Bostic, Mount Olive, AL (US)

( * ) Notice: Subject to any disclaimer, the term of this patent is extended or adjusted under 35 U.S.C. 154(b) by 0 days.

(21) Appl. No.: 16/911,936

(22) Filed: Jun. 25, 2020

(65) Prior Publication Data

US 2021/0308556 A1 Oct. 7, 2021

Related U.S. Application Data

(60) Provisional application No. 63/005,510, filed on Apr. 6, 2020.

(51) Int. Cl.

| | |
|---|---|
| ***A63F 1/04*** | (2006.01) |
| ***A63F 3/00*** | (2006.01) |
| *A63F 9/04* | (2006.01) |
| *A63F 9/00* | (2006.01) |

(52) U.S. Cl.

CPC ..... *A63F 1/04* (2013.01); *A63F 3/00697* (2013.01); *A63F 3/00145* (2013.01); *A63F 9/04* (2013.01); *A63F 2001/0441* (2013.01); *A63F 2003/00223* (2013.01); *A63F 2003/00233* (2013.01); *A63F 2003/00747* (2013.01); *A63F 2003/00839* (2013.01); *A63F 2003/00845* (2013.01); *A63F 2003/00946* (2013.01); *A63F 2003/00949* (2013.01); *A63F 2003/00955* (2013.01); *A63F 2009/0012* (2013.01)

(58) Field of Classification Search

CPC .... A63F 3/00088; A63F 3/00145; A63F 3/04; A63F 2011/0004; A63F 2003/00233; A63F 2003/0094; A63F 2003/00946; A63F 2003/00949; A63F 2009/0012

USPC ..... 273/251, 252, 254, 256, 250, 253, 290, 273/288, 287, 249, 243, 248

See application file for complete search history.

(56) References Cited

U.S. PATENT DOCUMENTS

| | | | | |
|---|---|---|---|---|
| 3,658,337 | A | 4/1972 | Peters et al. | |
| 3,994,499 | A * | 11/1976 | Barlow | A63F 3/00072 273/256 |
| 4,283,059 | A | 8/1981 | Beeder | |
| 4,377,287 | A | 3/1983 | Erwin | |
| 4,643,430 | A * | 2/1987 | D'Aloia | A63F 3/00072 273/252 |
| 4,887,818 | A | 12/1989 | Escott | |
| 5,139,266 | A | 8/1992 | Mullins et al. | |
| 5,250,000 | A * | 10/1993 | Boutin | A63F 3/0023 206/315.1 |
| 2004/0239030 | A1 * | 12/2004 | Sargent | A63F 3/00006 273/236 |

(Continued)

*Primary Examiner* — Benjamin Layno

(74) *Attorney, Agent, or Firm* — Boudwin Intellectual Property; Daniel Boudwin

(57) ABSTRACT

A kit for a game system and a method of using the kit is shown and described. The kit for the game system includes a game board, at least one die, a plurality of packable items, a plurality of game cards, and a plurality of suitcases. The plurality of game cards has indicia of the packable items located thereon. The method of use begins by setting up a game board, followed by determining a first player. The first player rolls a die and interprets the die. The first player moves a player pawn and draws a game card. The first player then does as the game card instructs.

13 Claims, 5 Drawing Sheets

(56) References Cited

U.S. PATENT DOCUMENTS

2007/0246885 A1* 10/2007 Timothy ..... A63F 1/00
273/298

* cited by examiner

KIT FOR A GAME SYSTEM AND METHOD OF USE

CROSS REFERENCE TO RELATED APPLICATIONS

This application claims the benefit of U.S. Provisional Application No. 63/005,510 filed on Apr. 6, 2020. The above identified patent application is herein incorporated by reference in its entirety to provide continuity of disclosure.

BACKGROUND OF THE INVENTION

The present invention relates to a game kit. More particularly, the present invention provides a unique and interactive game kit and method for using the same.

In this day and age, people enjoy getting together and playing games. However, it is becoming increasingly difficult to find new and innovative board games. Many companies are moving toward electronic development. This means that new board games are being developed at a much slower rate. This leaves people wanting a new and interactive form of entertainment.

Further, many individuals struggle to properly pack a suitcase. With the increasing costs to fly due to baggage fees learning how to pack a suitcase is becoming essential. There is currently no fun way to teach this skill. This means that many individuals are paying excessive amounts in fees because they do not properly pack.

Consequently, there is always a need for new interactive games. The present invention substantially diverges in design elements from the known art while at the same time solves a problem many people face when looking for non-electronic forms of entertainment. In this regard the present invention substantially fulfills these needs.

SUMMARY OF THE INVENTION

The present invention provides a kit for a game system and a method for using the kit. The kit for a game system is comprised of a game board, at least one die, a plurality of packable items, a plurality of game cards, and a plurality of suitcases. The game cards have indicia of the packable items located thereon.

Another object of the kit for a game system is to provide a game board which has a path thereon.

Another object of the kit for a game system is to provide a path on the game board which has a plurality of defined spaces.

Another object of the kit for a game system is to provide a kit where each of the plurality of suitcases are miniature suitcases.

Another object of the kit for a game system is to provide a kit where each of the plurality of suitcases has non-flexible walls.

Another object of the kit for a game system is to provide a plurality of packable items that are miniature items.

Another object of the kit for a game system is to provide a six-sided cubic die.

Another object of the kit for a game system is to provide a decorative box, wherein the box is proportioned to hold all of the items in the kit.

Another object of the kit for a game system is to provide the following packable items: a gumball machine, a rake, a shovel, a broom, a television, a book, at least one lollipop, at least one sugar bag, at least one flour bag, a suit of armor, a violin, a pair of sunglasses, sunscreen, a pair of flip flops, a swim suit, a plurality of pairs of pants, at least one necklace, at least one coconut, candy, at least one towel, a plurality of T-shirts, a beach ball, a sewing machine, and a stuffed teddy bear.

Another object of the kit for a game system is to provide a plurality of pawns, wherein the plurality of pawns are player pieces.

Another object of the kit for a game system is to provide a plurality of pants in different sizes.

Another object of the kit for a game system is to provide a plurality of T-shirts in different sizes.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
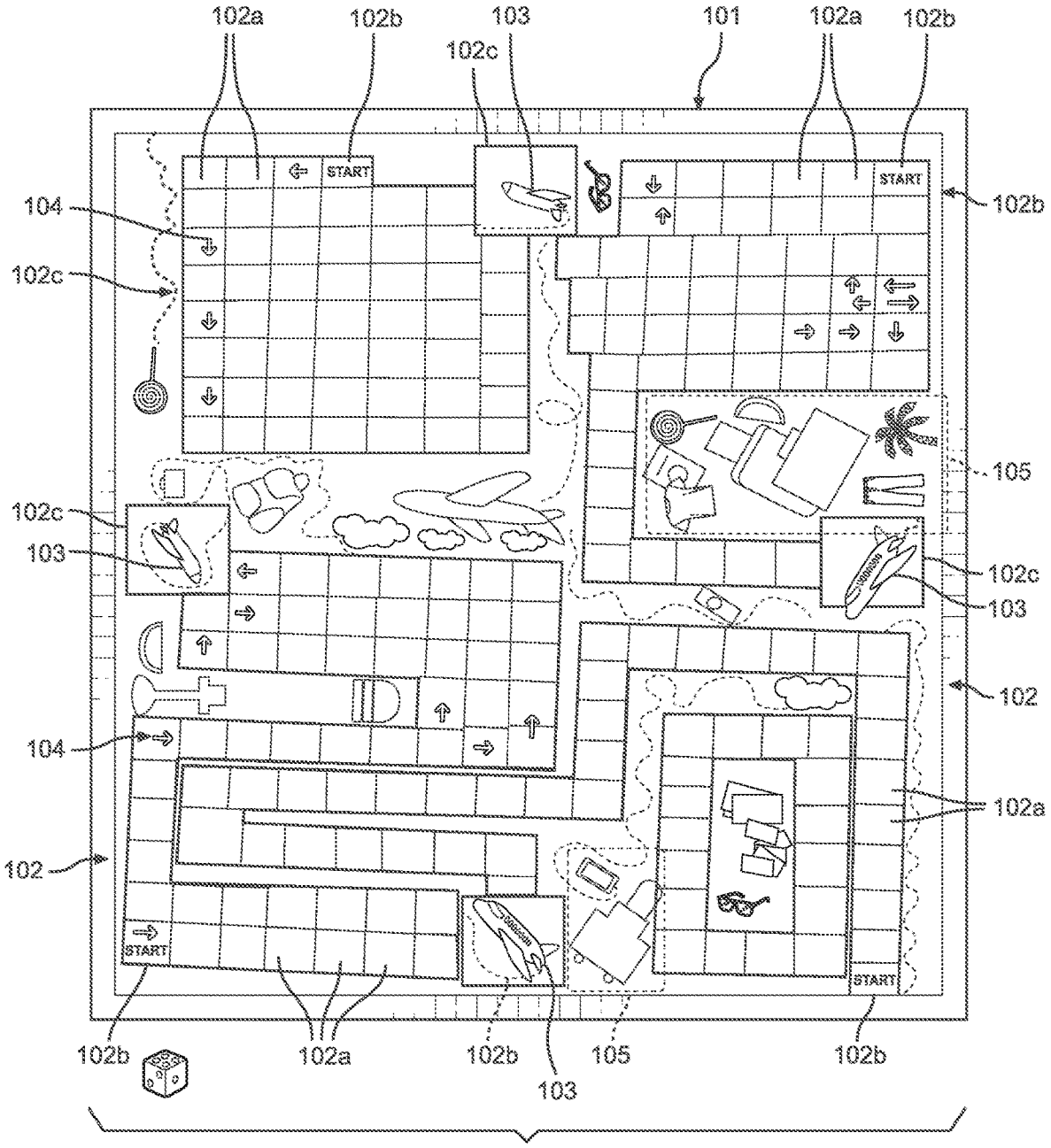
FIG. 1 shows a top down view of an embodiment of the board for the game system.

Reference is made herein to the attached drawings. Like reference numerals are used throughout the drawings to depict like or similar elements of the kit for a game system and a method for using the kit. For the purposes of presenting a brief and clear description of the present invention, a preferred embodiment will be discussed as used for the kit for a game system and a method for using the kit. The figures are intended for representative purposes only and should not be considered to be limiting in any respect.

Referring now to FIG. 1, there is shown a top down view of an embodiment of the board for the game system. The game system includes a game board 101. In the shown embodiment the game board 101 is a square. In other embodiments the game board 101 is another geometric shape. In one embodiment the game board 101 is constructed of a paper material. This will ensure the game board 101 is lightweight and easy to print indicia on. In another embodiment the game board 101 is made from plastic. Plastic will create a more robust game board 101.

In the shown embodiment the game board 101 has a multitude of player paths 102 shown thereon. In other embodiments the game board 101 includes only one player path 102. The player path 102 is a plurality of adjacent geometric shapes 102*a*. The shapes 102*a* create a player space. Each player path 102 has a start space 102*b* shown. The start space 102*b* is shown at the beginning of the player path 102. Each player path 102 also has an end space 102*c*. In the shown embodiment each end space 102*c* is marked with an indicium of an airplane 103. In some embodiments the player path 102 is marked with directional arrows 104. The directional arrows 104 will help players navigate the correct direction to travel along the player path 102.

In many embodiments the game board 101 has many aesthetically pleasing features. In one embodiment each shape 102*a* is colored. In one embodiment a plurality of colors are used. In another embodiment there are various indicia 105 shown around the game board 101. In one embodiment these indicia 105 are airport related.

Figure 2:
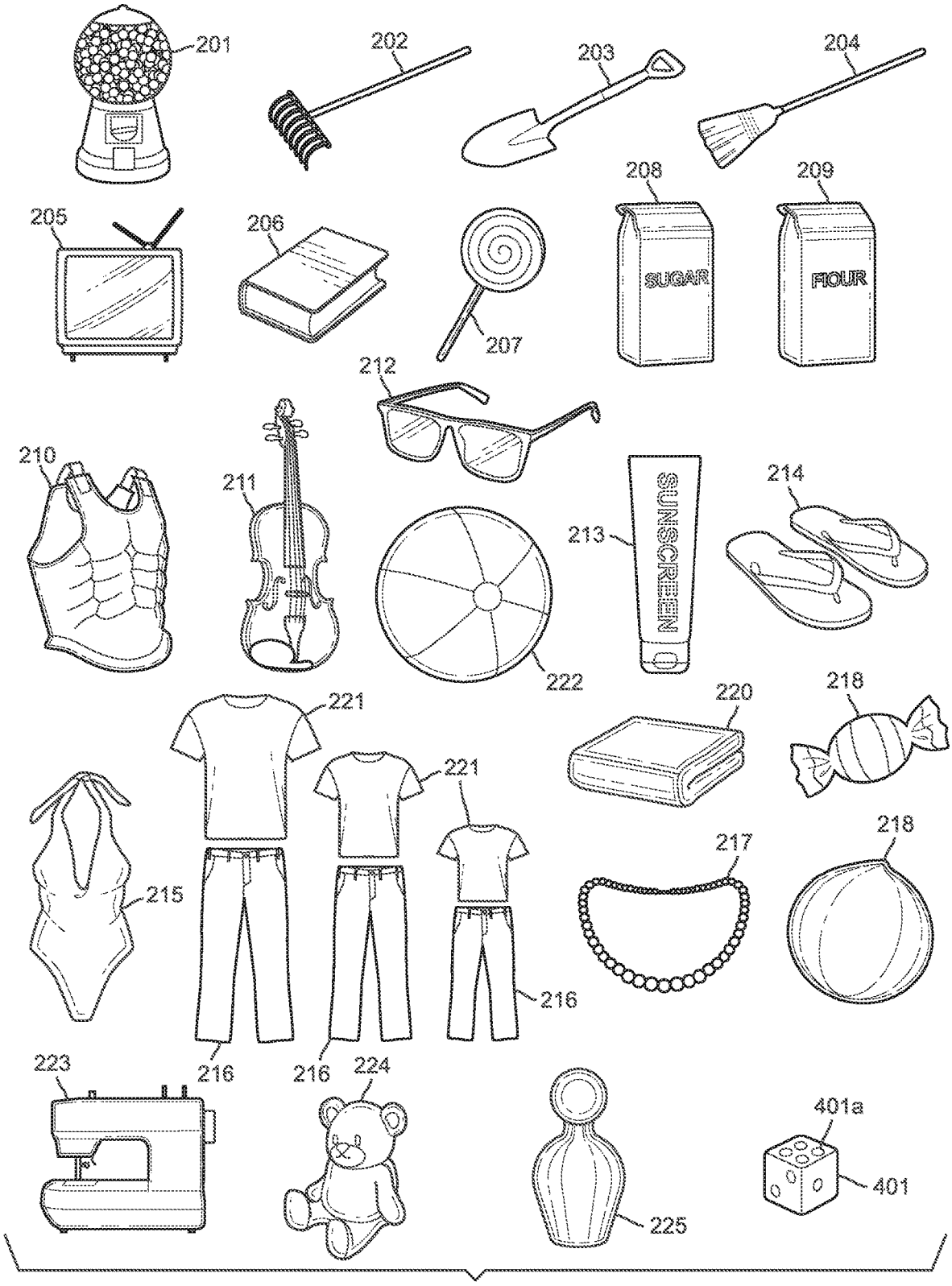
FIG. 2 shows a perspective view an embodiment of many of the parts associated with the game system.

Referring now to FIG. 2, there is shown a perspective view an embodiment of many of the parts associated with the game system. The kit for the game system includes a plurality of items. In one embodiment the items are miniature items. Each of the plurality of items will be proportioned to fit within the model suit cases as described in FIG. 4.

In different embodiments the items include: a gumball machine 201, a rake 202, a shovel 203, a broom 204, a television 205, a book 206, at least one lollipop 207, at least one sugar bag 208, at least one flour bag 209, a suit of armor 210, a violin 211, a pair of sunglasses 212, sunscreen 213, a pair of flip flops 214, a swim suit 215, a plurality of pairs of pants 216, at least one necklace 217, at least one coconut 218, candy 219, at least one towel 220, a plurality of T-shirts 221, a beach ball 222, a sewing machine 223, and a stuffed teddy bear 224. In different embodiments different items are selected. In other embodiments additional items may be included to the kit. In one embodiment the plurality of pairs of pants 216 come in different sizes. In one embodiment the different sizes of the plurality of pairs of pants 216 represent small, medium, and large. In another embodiment the plurality of T-shirts 221 come in different sizes. In one embodiment the different sizes of the plurality of T-shirts 221 represent small, medium, and large.

The game system kit includes a cubed die 401. The cubed die 401 has indicia 401*a* thereon. The indicia 401*a* represent numbers 1-6. This will allow a player to determine a number based on the indicia 401*a*.

The game system also includes a plurality of player pawns 225. The player pawns 225 will have defining characteristics such that the pawns can be distinguished from one another. In one embodiment the player pawns 225 are different colors. In the shown embodiment the player pawn 225 has a bowling pin shape. However, other shapes may be used.

Figure 3:
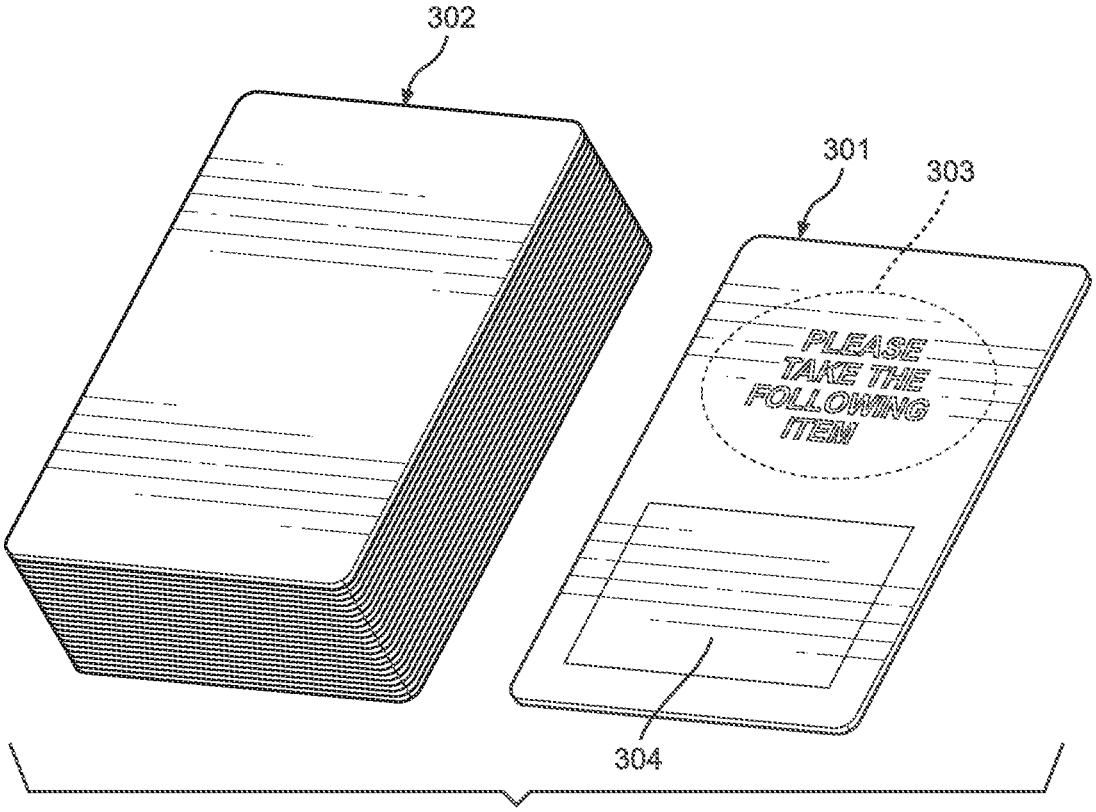
FIG. 3 shows a perspective view of an embodiment of a deck of game cards and a single card associated with the game system.

Referring now to FIG. 3, there is shown a perspective view of an embodiment of a deck of playing cards and a single card associated with the game system. The game system further includes a plurality of game cards 301 creating a deck 302. Each game card 301 has an instruction 303 thereon. In the shown embodiment the game card 301 states to take the following item. In this embodiment the game card 301 further has an indicium of the item 304 to be taken.

In another embodiment the instruction 303 reads pick an item and draw another card. In a second embodiment the instruction 303 reads "TSA Check." When "TSA Check" is on a card a player loses their turn and play skips to the next player. In yet a further embodiment the instruction 303 reads "flight delay" and the next player will be skipped. In another embodiment the instruction 303 reads "trade item", the player can trade items with another player. In yet a further embodiment the instruction 303 reads "cancelled flight" and the player must go back to the beginning of the player path. In one embodiment a player must keep all items within their suit case when they return to start.

Figure 4:
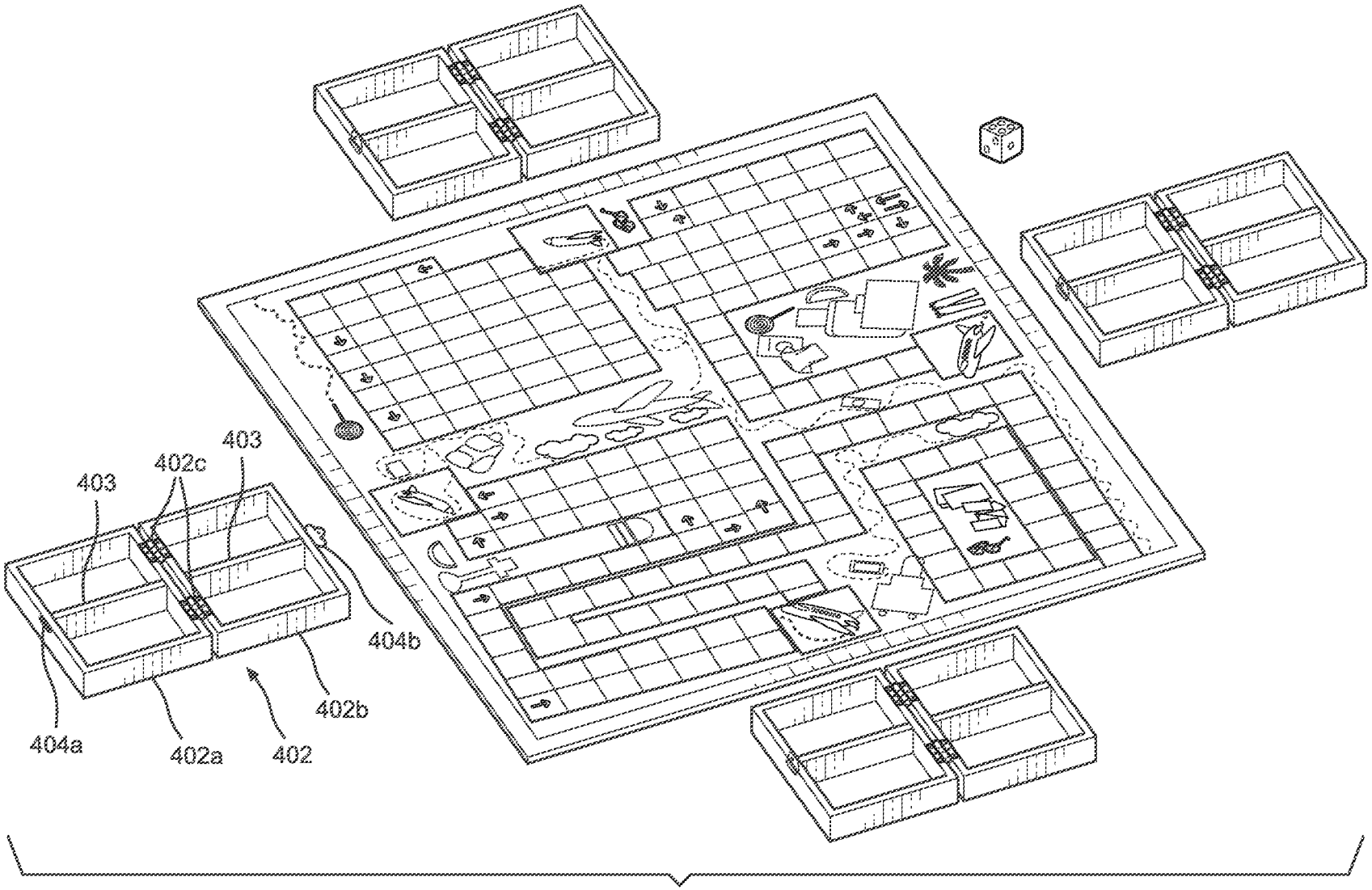
FIG. 4 shows a perspective view of an embodiment of suitcases associated with the game system.

Referring now to FIG. 4, there is shown a perspective view of an embodiment of suitcases associated with the game system. The kit for a game system also includes a plurality of model suitcases 402. In one embodiment there is a model suitcase 402 for each player. In other embodiments there are more model suitcases 402 that there are players. Each model suitcase 402 has a top section 402*a* and a bottom section 402*b*. In the shown embodiment the top section 402*a* and the bottom section 402*b* are connected together. In one embodiment the top section 402*a* and the bottom section 402*b* are connected with a hinge 402*c*. This will allow the top section 402*a* to meet with the bottom section 402*b*. The model suitcase 402 is made from a solid material. This will prevent the model suitcase from flexing when items are placed therein.

In one embodiment the model suitcase 402 has at least one divider 403 located therein. The divider 403 will separate parts of the interior of the model suitcase 402. In another embodiment the model suitcase 402 has a clasp 404*a*, 404*b* secured to an exterior of the suitcase 402. The clasp has a first part 404*a* secured to the top section 402*a* of the model suitcase 402. The clasp has a second part 404*b* secured to the bottom section 402*b* of the model suitcase 402. The clasp 404*a*, 404*b* is configured to mate and secure the model suitcase in a closed configuration.

Figure 5:
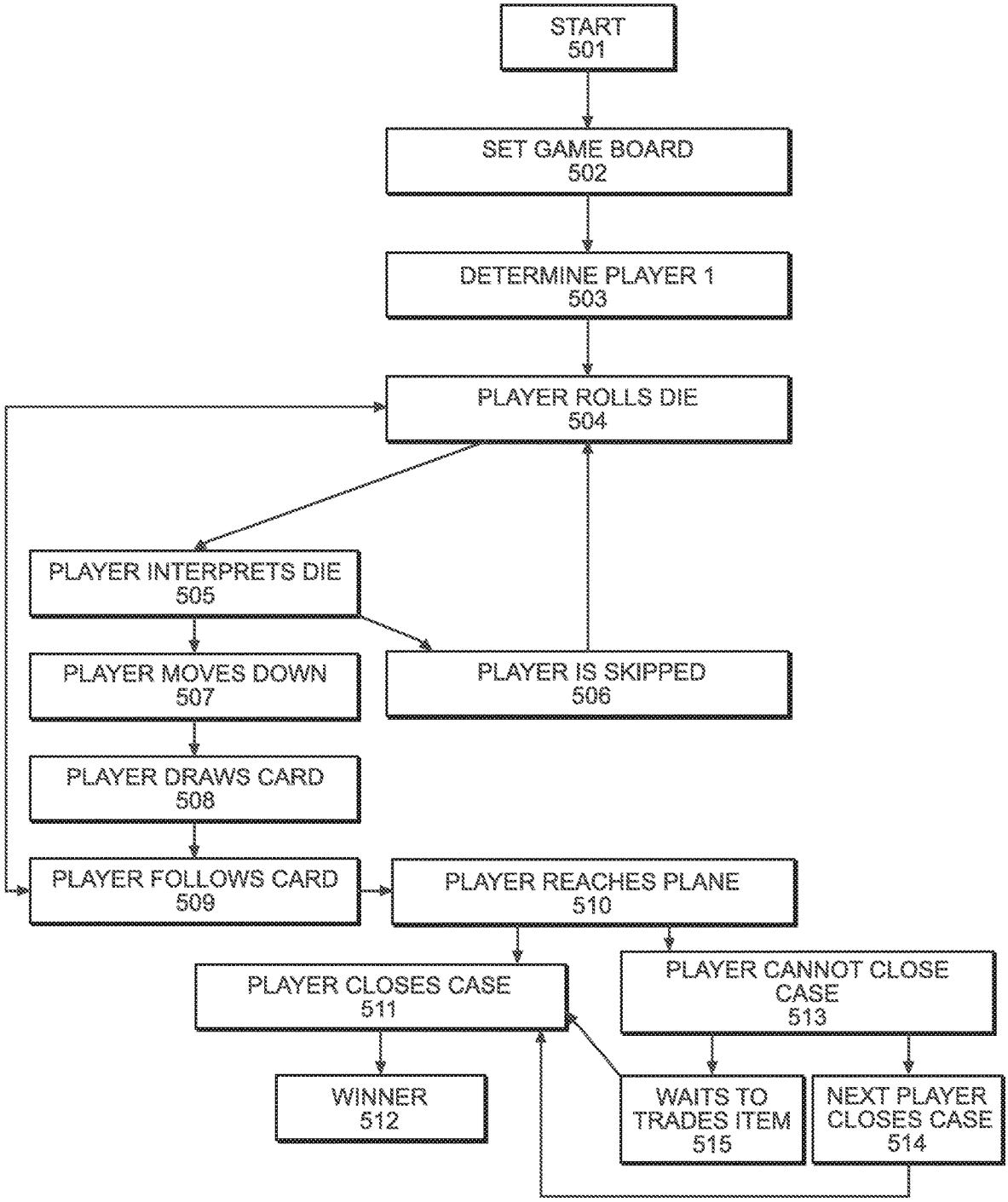
FIG. 5 shows a flow chart of one embodiment of a method of using the game system.

Referring now to FIG. 5, there is shown a flow chart of one embodiment of a method of using the game system. The method starts 501 by setting the game board 502. To set the game board 502 the playing cards should be shuffled, and a player piece for each player should be placed at the designated start space. Next, the first player is determined 503. This determination can be made in a number of ways. For example, every player may roll the die and the highest dice roll goes first.

Next a player will roll the die 504. Once the die stops moving the player interprets the die 505. If the player rolls a 6 on the die the player is skipped 506. If the player is not skipped the player moves the player pawn 507 a number of spaces equivalent to the number rolled. Next the player draws a card from the deck of cards 508. The player then follows the instructions on the card 509. Once the card is followed the next player rolls the die and the process 504-509 will be repeated until a player reaches a plane 510.

Once a player reaches the plane or end space 510 the end of the method begins. For this phase the player that reached the plane 510 will attempt to close their model suitcase 511. If the model suitcase closes the player wins 512. If the player cannot close the model suitcase 513 the player's turn is over and the next player attempts to close their mode suit case 514. If this player closes their model suitcase 511 then they win 512. This process continues until the original players turn is reached. At this time the player trades an item 515 and attempts to close their model suitcase again. In one embodiment a play may only trade an item if they are in possession of a trade item card. This process will continue until a player closes their model suitcase 511 and becomes the winner 512.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A kit for a game system, the kit comprising:

a game board;

at least one die;

a plurality of packable items;

wherein the plurality of packable items are of varying sizes and shapes;

a plurality of game cards, wherein the cards have indicia of the packable items located thereon;

a plurality of suitcases, each suitcase comprising a top section and a bottom section connected together with a hinge;

wherein each suitcase of the plurality of suitcases is closeable when the top section and the bottom section meet and defines an interior volume;

wherein each packable item of the plurality of packable items is sized to be removably disposed within the plurality of suitcases;

wherein each suitcase is of a volume such that each suitcase is not closable when the volume of the plurality of packable items disposed in a suitcase exceeds the volume of the suitcase.

2. The kit for a game system of claim 1, wherein the game board has a path thereon.

3. The kit for a game system of claim 2, wherein the path on the game board has a plurality of defined spaces.

4. The kit for a game system of claim 1, wherein each of the plurality of suitcases are miniature suitcases.

5. The kit for a game system of claim 1, wherein each of the plurality of suitcases has rigid walls.

6. The kit for a game system of claim 1, wherein the plurality of packable items are miniature items.

7. The kit for a game system of claim 1, wherein the at least one die is a cube die.

8. The kit for a game system of claim 1, further comprising a decorative box, wherein the box is proportioned to hold all of the items in the kit.

9. The kit for a game system of claim 1, wherein the plurality of packable items includes: a gumball machine, a rake, a shovel, a broom, a television, a book, at least one lollipop, at least one sugar bag, at least one flour bag, a suit of armor, a violin, a pair of sunglasses, sunscreen, a pair of flip flops, a swim suit, a plurality of pairs of pants, at least one necklace, at least one coconut, candy, at least one towel, a plurality of T-shirts, a beach ball, a sewing machine, and a stuffed teddy bear.

10. The kit for a game system of claim 9, wherein the plurality of pants are different sizes.

11. The kit for a game system of claim 9, wherein the plurality of T-shirts are different sizes.

12. The kit for a game system of claim 1, further comprising a plurality of pawns, wherein the plurality of pawns are player pieces.

13. A method for using the game system kit, the method comprising the steps of:

providing a plurality of suitcases;

providing a plurality of player pawns;

providing a plurality of packable items, wherein the plurality of packable items are of varying sizes and shapes;

providing a plurality of game cards, each game card having an instruction thereon;

setting up a game board, the game board defining a set path of a plurality of defined spaces;

assigning a player pawn and a suitcase to each player;

wherein each suitcase comprising a top section and a bottom section connected together with a hinge, wherein when the top section and bottom section meet, each suitcase closes defining an interior volume and is configured to open and close around the interior volume;

wherein each packable item of the plurality of packable items is sized to be removably disposed within the plurality of suitcases;

wherein each suitcase is of a volume such that each suitcase is not closeable when the volume of the plurality of packable items disposed in a suitcase exceeds the volume of the suitcase;

determining a player order, including a first player;

the first player rolling a die;

interpreting a die roll to determine a number of defined spaces which the first player may move;

moving player pawn of the first player in the number of defined spaces;

drawing a game card;

following instructions on the drawn game card;

wherein the instruction is selected from the group consisting of: selecting a packable item and placing the packable item in a suitcase, trading a first packable item for a second packable item of another player, and returning to start;

repeating the die roll step through the card drawing step for all subsequent players until the game cards are depleted, restarting at the first player once a final player has completed the die roll step through the card drawing step;

upon reaching an end of the set path, the player reaching the final space attempting to close the suitcase, containing the plurality of packable items selected therein;

wherein the winner is the player to reach the end of a set path on the game board while being able to close a suitcase.

* * * * *